United States Patent [19]

Denkmann et al.

[11] Patent Number: 4,650,269

[45] Date of Patent: Mar. 17, 1987

[54] MODULAR PLUG CONNECTOR

[75] Inventors: W. John Denkmann, Carmel, Ind.; Paul R. Gustin, Monkton, Md.; George W. Reichard, Jr., Carmel, Ind.

[73] Assignee: AT&T Information Systems Inc., Indianapolis, Ind.

[21] Appl. No.: 776,272

[22] Filed: Sep. 16, 1985

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,761,869 | 9/1973 | Hardesty et al. | 339/99 |
| 3,860,316 | 1/1975 | Hardesty | 339/91 |
| 3,954,320 | 5/1976 | Hardesty | 339/99 |
| 4,002,392 | 1/1977 | Hardesty | 339/99 |
| 4,089,580 | 5/1978 | Huffnagle et al. | 339/99 |
| 4,148,539 | 4/1979 | Hardesty | 339/99 |
| 4,270,831 | 6/1981 | Takahashi | 339/99 |
| 4,431,246 | 2/1984 | Vaden | 339/97 P |

*Primary Examiner*—Joseph H. McGlynn

*Attorney, Agent, or Firm*—M. A. Morra

[57] ABSTRACT

A modular plug connector is adapted to terminate a cord having a number of insulated solid wire conductors. The connector includes a dielectric housing that facilitates interconnection between the solid wire conductor and a metallic terminal which slides into a terminal-receiving slot of the dielectric housing. The metallic terminal includes three tangs, or blades, that pierce the insulation surrounding the solid wire and achieve electrical contact. Adjacent tangs grasp the solid wire on opposite sides of its center line, but are controllably spread before making contact with the wire by cam surfaces molded into the side walls of the terminal-receiving slot. Reliable connections are therefore made between a metallic terminal and a solid wire conductor without severing it.

13 Claims, 11 Drawing Figures

MODULAR PLUG CONNECTOR

FIELD OF THE INVENTION

This invention relates to apparatus for terminating electrical cords, and more particularly to a modular plug connector.

BACKGROUND OF THE INVENTION

The telephone industry has for many years found it convenient to utilize modular plugs and jacks with which to interconnect telephone handsets and bases as well as associated equipment. Indeed, even keyboards and video display terminals benefit from the use of such modular equipment.

A modular plug performs the task of terminating one or more individual wires within a dielectric housing that conveniently connects to an associated modular jack and provides electrical continuity therebetween. Modular plugs comprise a dielectric housing having a plurality of ducts, each receiving an individual conductor surrounded by a relatively soft insulating material. After insulated conductors are positioned in the dielectric housing, metallic terminals having one or more sharp edges (tangs) at one end are inserted into slots of the housing so as to pierce the insulation and make electrical contact with the conductor. The other end of the terminal comprises a surface adapted to make electrical contact with wires included in a mating jack receptacle.

An early example of such a connecting device is shown in U.S. Pat. No. 3,761,869 issued to Hardesty et al on Sept. 25, 1973. In this patent each terminal includes several pointed blades for penetrating a conductor's insulating material as well as the conductor itself. This technique works quite well with what is known as "tinsel" conductor or with stranded wire; but, certain problems are encountered when solid wire is used; namely, the individual tangs may sever the solid wire during assembly of the plug and, in time, separation may occur causing the electrical path to open.

An insulation piercing contact, designed for use in connection with solid wire, is disclosed in U.S. Pat. No. 4,431,246 issued to J. L. Vaden on Feb. 14, 1984. This patent shows a terminal contact having three tangs with adjacent ones beveled in opposite directions at their bottom edge. When the terminal is properly urged into direct contact with the insulated solid wire, adjacent tangs not only penetrate the insulation but also make contact with the solid wire on opposite sides of its center line. The tangs are beveled at the bottom edge and generally tapered such that they are thinner at the bottom than where they are connected to the upper portion of the terminal. This particular technique also relies on the proper positioning of an insulated conductor for an acceptable electrical connection to be made. It has been found, however, that while beveling and tapering provide some degree of control in assuring a proper connection between metallic terminals and conductors, greater control is desirable.

It is therefore an object of this invention to provide a modular plug for terminating electrical cords having solid wire conductors without severing the wire during assembly.

It is another object of this invention to relax tolerances associated with beveling, tapering and conductor placement in providing consistent, reliable connections between metallic terminals and solid wire conductors.

SUMMARY OF THE INVENTION

The connector of the present invention is adapted to terminate a cord having a plurality of insulated solid wire conductors. The connector includes a dielectric housing for receiving solid wire conductors in ducts and for receiving metallic terminals in slots for the purpose of joining them electrically. Each slot is associated with an individual duct and is oriented substantially perpendicular thereto. Slots of the dielectric housing extend along the direction of the duct and have cam surfaces (protuberances) in their vertical walls that operate to spread the adjacent tangs of an inserted terminal in opposite directions about the center line of a conductor lying in the associated duct.

In a preferred embodiment of the invention each terminal comprises three tangs for grasping a solid wire on opposite adjacent sides thereby containing the opposing forces within the terminal itself. Each slot in the dielectric housing includes a pair of side walls that face each other in close proximity and have alternately spaced cam surfaces in the walls that function to spread adjacent tangs of an inserted terminal in opposite directions.

It is a feature of this invention that the cam surfaces are molded into the dielectric housing and thus eliminate the cost associated with creating metallic terminals having precisely tapered and beveled tangs.

It is another feature of the present invention that the cam surfaces are positioned at the interface between each slot and its associated duct; and thus the tangs of each terminal are controllably spread to penetrate the insulation and grasp the conductor with great accuracy.

These and other objects and features of the invention will be seen when taken together with the following figures and detailed description.

Figure 3:
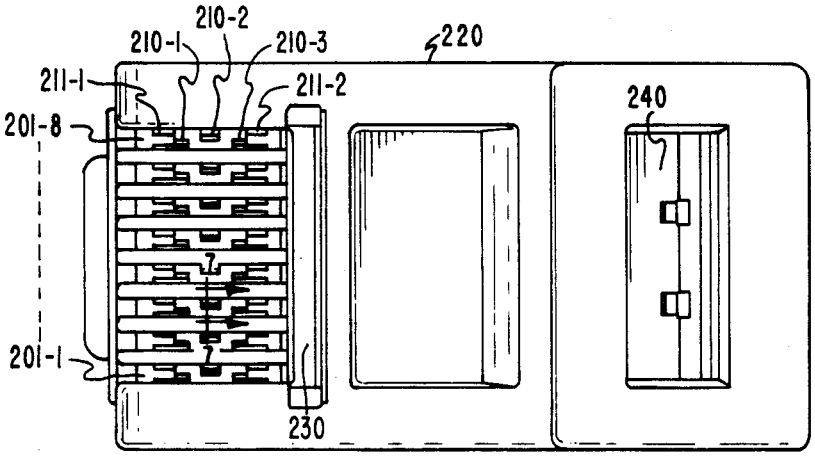
FIG. 3 is a top view of the plug housing of FIG. 2 in accordance with the present invention.
Figure 8:
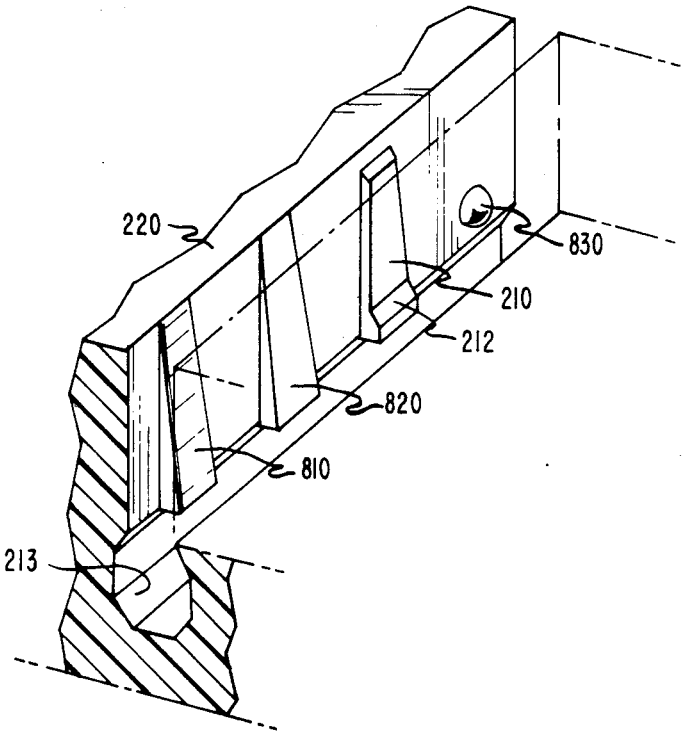

FIGS. *6a* and *6b* are front and side views of a metallic terminal used in connection with the plug housing of the invention;

FIGS. *7a, 7b* and *7c* are sectional views of a portion of FIG. 3 demonstrating the cooperation between the metallic terminal of FIGS. *6a, 6b* and the side walls of the plug housing during various stages of insertion; and FIG. 8 illustrates various shapes for a cam surface incorporated into the side wall of a plug housing in accordance with the invention.

DETAILED DESCRIPTION

Figure 1:
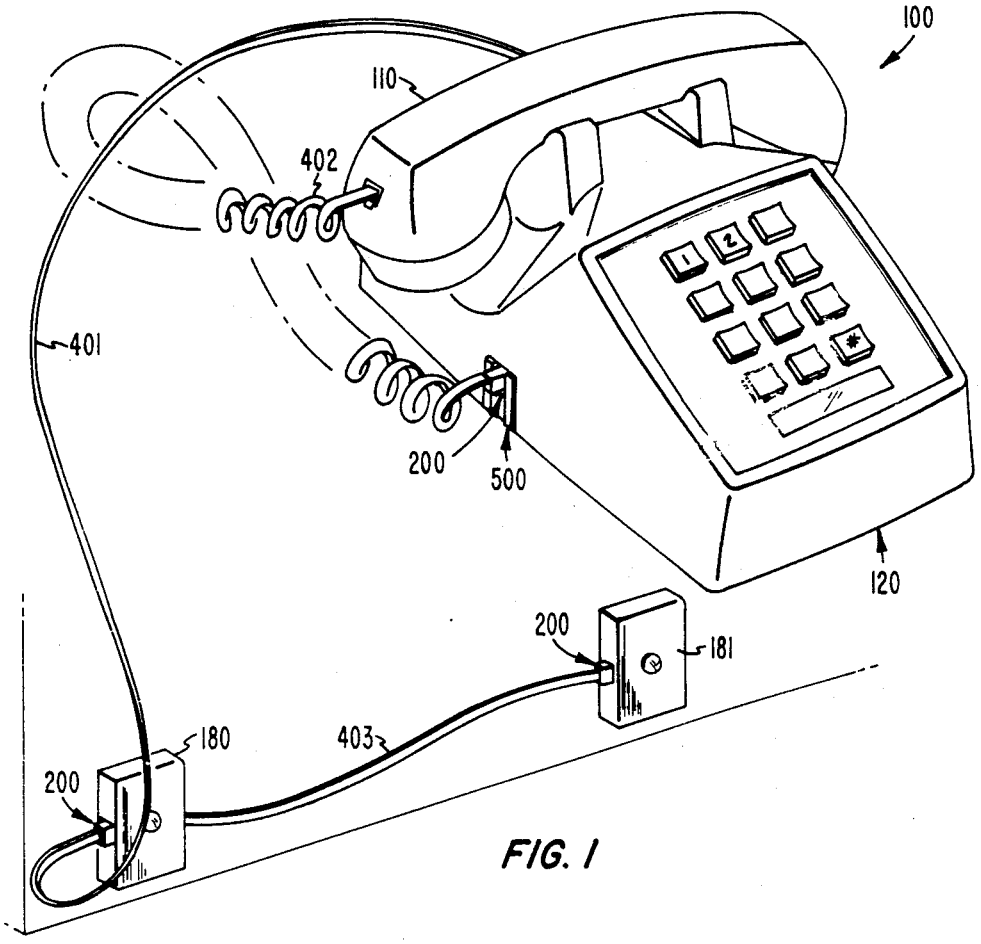
FIG. 1 illustrates a telephone station installation and various associated electrical interconnections using modular plugs constructed in accordance with the principles of this inventions.

FIG. 1 discloses various electrical interconnections associated with a telephone station that use modular plugs. Telephone set 100 comprises handset 110 and base 120 interconnected by retractile cord 402. Terminal block 180 connects to telephone base 120 by way of line cord 401 and to terminal block 181 by way of distribution cord 403. Each of these cords is equipped with a modular plug designated 200 to make electrical contact through a modular jack. The present invention resides in an improved construction for modular plugs which primarily benefits cords having solid wire conductors such as line cord 401 and distribution cord 403. The invention may also be used with cords having tinsel or stranded wire conductors such as retractile cord 402, but with less benefit.

Figure 2:
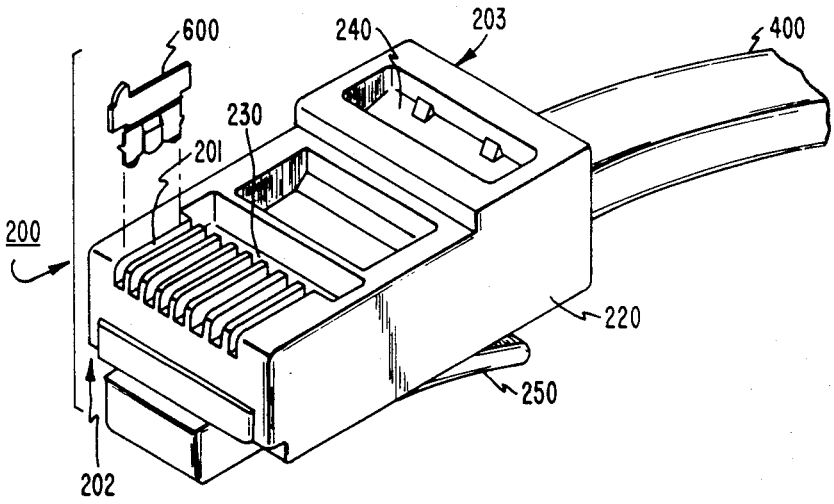
FIG. 2 is a perspective view of a modular plug with particular emphasis on one of a plurality of terminals to be seated in one of a plurality of terminal receiving slots in the plug housing.

Referring to FIG. 2 a more detailed view of the construction of modular plug 200 is observed. Modular plug 200 comprises plug housing 220 and a number of metallic terminals 600 to be inserted into a corresponding number of slots 201-n contained in the housing. In FIG. 2 there are eight terminal receiving slots, illustratively shown, each extending downwardly from the top surface of plug housing 220 into a conductor-receiving duct that contains one of the wires from cord 400.

Modular plug construction is well known and described in various patent applications. Housings comprising multiple dielectric piece parts are disclosed in U.S. Pat. No. 3,761,869 or comprising a single dielectric part (unipartite construction) are disclosed in U.S. Pat. No. 3,954,320 both issued in the name of Hardesty, assigned to the Western Electric Company and incorporated by reference herein. Although not limited to a particular embodiment, plug housing 220 in the present invention is a unipartite rigid housing made from a dielectric material such as polycarbonate. The housing includes a so-called free or termination end 202 and a cord input end 203 having a flared cord input aperture designed to circumscribe generally the outer periphery of the largest cord 400 expected to be terminated in plug housing 220.

Plug housing 220 further includes conductor strain relief area 230 which is deflected downward during assembly to anchor the conductors in engagement with the bottom of the chamber in order to provide strain relief for the conductors. Such strain relief is discussed in U.S. Pat. Nos. 3,860,316 and 4,002,392 which are incorporated by reference herein. Modular plug 200 further includes jacket strain relief via member 240. Tab 250 is provided for locking plug 200 within an associated jack and its operation is described in U.S. Pat. No. 4,148,539.

FIG. 3 offers a top view of plug housing 220 particularly illustrating terminal receiving slot 201-1 through 201-8. For the purpose of illustration, slot 201-8 is shown having three cam surfaces 210-1, -2, and -3 that are respectively located along opposite sides of slot 201-8. Also shown in slot 201-8 are two pairs of centering ribs 211-1 and 211-2. These ribs help guide terminal 600 into slot 201-8 which is important because the terminal is somewhat thinner than the slot itself. As shown, cam surfaces 210 spread the tangs of a terminal in a direction perpendicular to the direction of insertion. It is understood that these cams can include a slight angle from the longitudinal axis of plug housing 220 so that the tangs of the terminal are twisted during insertion and thus cut into the insulated wire along one side edge of the tang.

Individual cams are designed into the plug housing in a manner that facilitates molding. The disclosed cams have a slight pyramidal shape in that they become wider as they extend downward. A molding insert, used to form the cams during the molding process, is therefore easily extracted. Advantageously, this pyramidal shape is ideal for spreading the tangs of a metallic terminal. Shapes for these cams are shown in greater detail in FIG. 4, 7 and 8.

Figure 4:
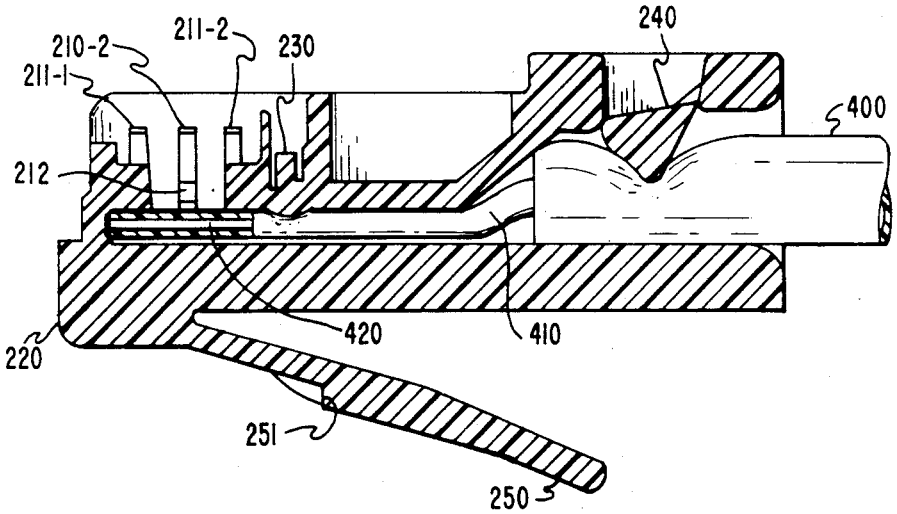
FIG. 4 is a cross-sectional view of a modular plug constructed in accordance with the principles of this invention.

FIG. 4 discloses a cross-sectional view of the subject modular plug with cord 400 inserted therein. Referring once again to the cam surfaces designated 210, note that ramp 212 is the downwardly sloping portion of the cam that spreads the tangs of the inserted metallic terminal. Other shapes for the cam surface include discretely stepped ramps and continuous ramps having linear, parabolic or exponentially sloped side walls (see, for example, FIG. 8). FIG. 4 further discloses the insertion of cord 400 into plug housing 220. Cord 400 includes a jacket that surrounds a plurality of insulated wires similar to wire 410 shown and conductor 420 located within the insulation. As discussed earlier, jacket strain relief is provided by the tab 240 for the cord while strain relief for the individual wires is provided by depressing area 230.

Conductor 420 is illustratively shown, with insulation removed, in its duct for electrical and mechanical connection with a metallic terminal to be inserted. Plug housing 220 includes ducts that are located at the bottom of, and perpendicular to, each of slots 201-1 through 201-8. A complete modular plug and jack assembly is shown in FIG. 5 including all major elements required to perform electrical and mechanical connection between modular plugs and jacks.

Figure 5:
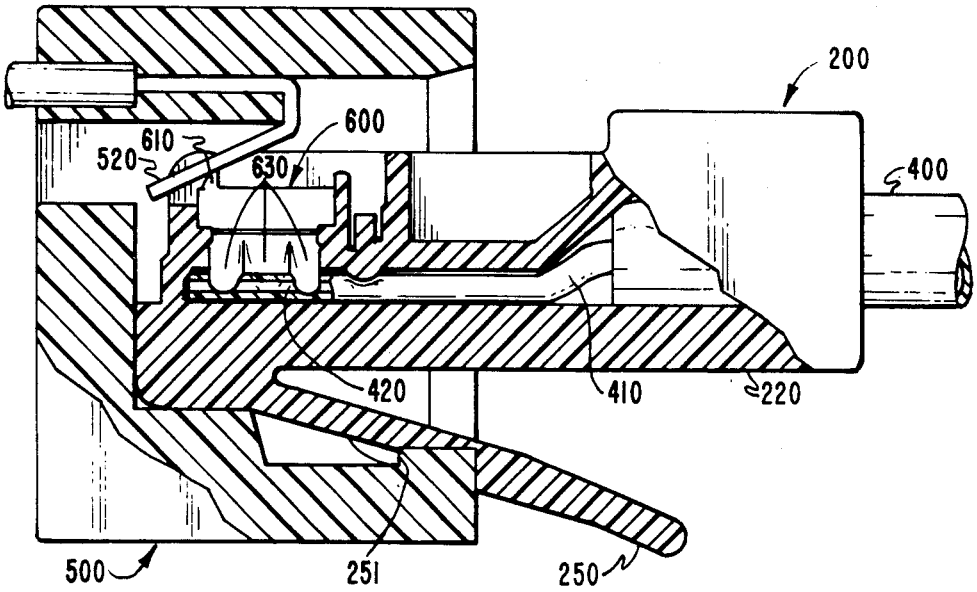
FIG. 5 discloses a complete interconnection sysrem utilizing a modular plug and jack, and illustrating with particularity the principal components involved in providing mechanical and electrical interconnection.

Referring to FIG. 5, plug housing 220 facilitates the interconnection between one conductor of cord 400 and one conductor of modular jack 500. It is the integrity of this electrical connection that modular plugs and jacks are designed to preserve. The electrical connection comprises a first connection between jack wire 520 and metallic terminal 600 and a second connection between metallic terminal 600 and conductor 420.

Modular jack 500 includes a plurality of wires 520 that make electrical contact to the metallic terminals inserted in the plug housing. When modular plug 200 is inserted into modular jack 500 each of the conductors 520 is deflected in the direction of insertion. The force exerted on the conductors, however, does not exceed their elastic limit and a restorative spring force exists between conductor 520 and fin 610 of metallic terminal 600 that maintains a good electrical connection. Typically, conductor 520 and metallic terminal 600 are a phosphor-bronze alloy for strength and include a precious metal surface layer to assure low resistivity and provide protection against contamination. Shoulder 251 of interlocking tab 250 cooperates with jack 500 to mechanically hold the plug and jack together. Metallic terminal 600 includes adjacent tangs 630 on opposite sides of solid wire conductor 420. The cam surfaces of plug housing 220 commence the spreading of tangs; thereafter, engagement with the solid wire itself completes the action. Electrical contact is assured, and conductor 420 is not severed. More complete detail of this piercing operation is shown in FIG. *7a*, *7b* and *7c*.

A particular embodiment of a metallic terminal structure is shown in FIG. *6a* and *6b*. Each of the terminals 600 is flat and blade-like and is made from a strip of electrically conductive material such as, for example, brass or phosphor-bronze alloy. The terminal has an overall height of 0.16 inches (including the 0.020 inch fin protrusion), an overall width of about 0.134 inches, and a thickness of 0.012 inches. Advantageously the use of ramps in the side walls of the plug housing allows the use of a narrow blade (i.e., 0.012 inches rather than 0.014 or 0.016 inches). When terminal 600 is fully seated within plug housing 220, the tangs 630 pierce through the insulation of, and engage electrically, wire 410. Terminal 600 also includes side edge barbs 620 which dig into the end walls of slots 201-1 through 201-8 of plug housing 220 to ensure that terminal 600 is securely fastened in the plug housing.

In order to engage an external component, terminal 600 includes an external contact portion. In a preferred embodiment, the external contact portion is configured to include fin-like protrusion 610 which extends from the body portion of terminal 600 and is disposed asymmetrically thereto. When terminal 600 is properly oriented in slot 201, protrusion 610 is positioned next to termination end 202 of plug housing 220.

In order to smooth the surface area of the terminal metal and to provide protection against corrosion, substantially its entire surface area is covered with a 0.0001 inch layer of nickel. The nickel as well as additional metallic material is generally applied by a process of electroplating, for example. Further, the nickel is plated with a 0.000005 inch layer of gold which is called a strike. This relatively thin layer of gold provides low insertion resistance and improved contact performance for tangs 630 by maintaining the surface area in a stable condition.

Selected surfaces of terminal 600, such as protrusion 610, are plated with additional metallic material such as gold, for example, to enhance the electrical connection between the contact wire of the jack (conductor 520) and the terminal.

Figure 6A:
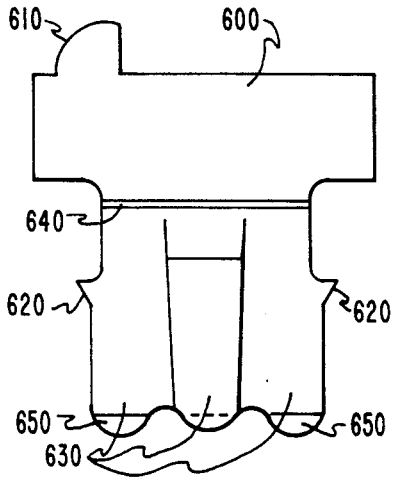
Figure 6B:
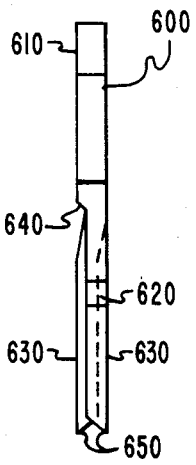

A side view of metallic terminal 600 is shown in FIG. 6*b*. Tangs 630 of the terminal are formed to include an offset in the region of shoulder 640 to facilitate insertion of the terminal into the plug housing. Additionally, the thickness of the tangs is decreased with respect to the body portion of the terminal, thereby reducing the force needed to spread the tangs during the insertion operation. Adjacent tangs are offset in opposite directions and beveled at the bottom in the direction of the offset to further facilitate insertion into the plug housing. While a preferred embodiment of the invention utilizes tangs that are deformed before insertion, the use of side wall ramps makes this largely unnecessary.

Figure 7A:
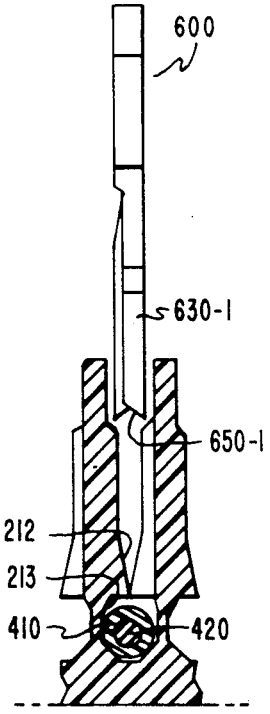
Figure 7B:
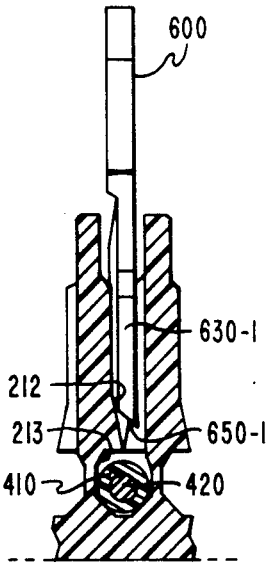
Figure 7C:
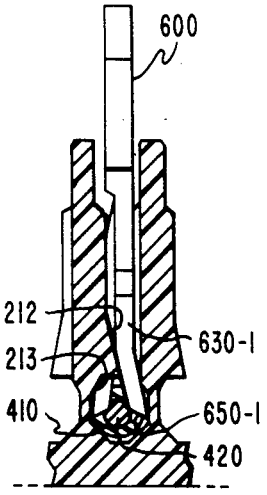

FIG. 7*a*, 7*b* and 7*c* represent a particular cross-section (designated 7-7 in FIG. 3) of metallic terminal 600 during various stages of insertion into slot 201 of plug housing 220. Initially, however, the dimensions associated with the terminal-receiving slot are discussed.

Plug housing 220 is constructed such that the spacing between adjacent terminal receiving slots 201 is nominally 0.040 inches and the terminal-receiving slot itself has an opening of 0.022 inches at the top surface of the housing. The distance from the top surface of the housing to the top of the duct is deep and 0.034 inches wide.

FIG. 7*a* illustrates the first stage of insertion whereby beveled surface 650-1 makes contact with ramp surface 211 during insertion if the terminal 600 is not vertically aligned.

In FIG. 7*b*, the beveled portion of tang 630-1 is shown making contact with ramp surface 212 and deflection of the tang commences.

FIG. 7*c* discloses the final stage of insertion whereby tang 630-1 has pierced the insulation of wire 410 and made contact with conductor 420. Since adjacent tangs of the terminal are spread in opposite directions, solid conductor 420 is firmly grasped and internal stresses are contained within the terminal and not delivered to the plug housing itself.

Referring now to the drawing of FIG. 8, various shapes of a cam surface are shown within the scope of the invention. These shapes are for the purpose of illustration and do not constitute a limitation. Accordingly, the names for these surfaces may differ and are variously referred to as protuberances, cam surfaces, ramps, bumps, dimples and the like. Nevertheless, it is clear that all such outcroppings in the side walls of a terminal-receiving slot function to controllably spread the tangs of a terminal during insertion and thereby achieve the advantages discussed. In FIG. 8, plug housing 220 is shown with various cam surfaces (810, 820, 210, 830) that extend from an exterior top surface to conductor-receiving duct 213 which holds an insulated solid wire conductor (not shown). Cam surface 210 includes downwardly sloping portions 211 and 212 as an example of a discretely stepped ramp. This particular ramp is used in FIG. 3–7.

It is understood that the above-described arrangements are simply illustrative of the invention. Other arrangements may be devised by those skilled in the art which will embody the principles of the invention and fall within the spirit and scope thereof.

What is claimed is:

1. In an electrical connector for terminating a cord having a plurality of insulated conductors, a dielectric housing including a number of conductor-receiving ducts extending in a generally straight line from one side of the housing toward an opposite side thereof, and further including a like number of associated slots for receiving terminals having a plurality of insulation piercing blades and making electrical contact with said conductors terminated within the dielectric housing, each slot extending horizontally along the direction of the duct and vertically from the top of the housing into the duct, each slot including a pair of side walls facing each other and having cam surfaces positioned along said walls in alternating sequence, whereby adjacent blades of each terminal are controllably spread in opposite directions by said cam surfaces when the terminal is inserted into the housing.

2. The dielectric housing of claim 1 wherein each slot includes a first and third cam surface positioned on one side wall, and a second cam surface positioned on the facing side wall between said first and third cam surfaces.

3. The dielectric housing of claim 1 characterized in that each cam surface on a side wall becomes continuously closer to or remains at a substantially fixed distance from the facing side wall as it descends from the top of the housing toward the conductor-receiving duct.

4. The dielectric housing of claim 3 further characterized in that each cam surface becomes wider in a direction parallel to the side walls as it descends from the top of the housing toward the conductor-receiving duct, whereby mold inserts are easily removable during the fabrication of said dielectric housing.

5. A modular plug for making an electrical connection between a conductor and a component external to the plug, said plug comprising:

a dielectric housing which includes a conductor-receiving end and a termination end, said housing including a duct for holding an end portion of the conductor and a terminal-receiving slot which communicates and is aligned with said duct and which opens to an exterior surface of said housing, said terminal-receiving slot including a pair of side walls, substantially parallel to each other, each having at least one ramp inclined toward the other side wall, the ramp being closest to the other side wall in the vicinity of the duct; and an electrically conductive flat blade-like terminal, positioned in the terminal-receiving slot, said terminal including a body portion and an internal contact portion extending from said body portion into the duct for making electrical engagement with the aligned conductor, the internal contact portion comprising a plurality of tangs, adjacent ones of which are spread in opposite directions by engagement with the ramps in the side walls.

6. The modular plug of claim 5 wherein the internal contact portion of said terminal comprises three tangs having a substantially uniform thickness, said thickness being less than the thickness of the body portion of the terminal, whereby the force required to spread the tangs is reduced.

7. The modular plug of claim 6 wherein the body portion and the internal contact portion of the terminal are substantially in the same plane, one of the tangs being slightly deformed such that it resides on one side of the plane while the other two tangs reside on the other side of said plane, whereby insertion of the terminal into the terminal-receiving slot is facilitated.

8. In combination:

a cord having a plurality of insulated conductors surrounded by a cord jacket for containing said insulated conductors;

a dielectric housing, which includes a cord-input end having a aperture receiving and circumscribing the cord, the housing also including conductor-receiving ducts and a plurality of terminal-receiving openings that extend along the direction of the ducts and communicate with the ducts and the exterior of the housing, each terminal-receiving opening having a pair of substantially parallel side walls facing each other and characterized by one or more protuberances on the surface of each wall, said protuberances being located on alternate walls of the pair along the direction of the ducts; and a plurality of electrically conductive blade-like terminals positioned within the dielectric housing, each terminal including:

an internal contact portion extending into the duct for piercing the insulation of and making electrical engagement with the conductor in the duct; and an external contact portion positioned within the associated terminal-receiving opening for making electrical contact external to the connector.

9. The combination of claim 8 wherein said plurality of insulated conductors are solid wire conductors.

10. The combination of claim 8 wherein the dielectric housing further includes jacket strain relief means for holding the cord and the housing in firm relation to each other.

11. The combination of claim 8 wherein the dielectric housing is of unipartite construction.

12. The combination of claim 11 wherein that portion of the protuberance nearer the duct is always equal to or larger in cross section than that portion of the protuberance nearer the exterior of the housing.

13. An electrical connector terminating a cord containing N insulated solid wire conductors for making electrical contact external to the connector which comprises:

a unipartite dielectric housing having N terminal-receiving openings, each extending from the top surface of the housing into an associated trough that contains an insulated solid wire conductor, each terminal-receiving opening comprising a pair of vertical side walls that face each other and three ramps molded into the side walls, two of said ramps being positioned on one side wall and the third ramp being positioned on the facing side wall generally between the other two ramps; and an electrically conductive terminal positioned within each of the N terminal-receiving openings, each terminal including a body portion and a row of three insulation displacing tangs extending therefrom and making electrical contact with the solid wire conductor in the conductor-receiving trough, adjacent tangs of the terminal being forced onto opposite sides of the solid wire conductor by the ramps in the side walls, whereby solid wires are not severed by the conductive terminals during insertion.

* * * * *